US005423693A

United States Patent [19]

Light

[11] Patent Number: 5,423,693

[45] Date of Patent: Jun. 13, 1995

[54] ELECTRICAL CORD, PLUG AND RECEPTACLE RETAINER AND LINE RETAINER

[76] Inventor: Jack W. Light, 2680 Clyde St., Matlacha, Fla. 33909

[21] Appl. No.: 242,172

[22] Filed: May 13, 1994

[51] Int. Cl.[6] ..... H01R 13/62

[52] U.S. Cl. ..... 439/369; 24/169 R

[58] Field of Search ..... 439/367, 368, 371, 369, 439/457; 24/71.2, 71.3, 129 A, 129 R

[56] References Cited

U.S. PATENT DOCUMENTS 2,461,427 2/1949 Kneebone ..... 439/369

3,781,761 12/1973 Harwood ..... 439/369

4,504,106 3/1985 Fechter ..... 439/369 X 5,336,106 8/1994 Osten ..... 439/369

FOREIGN PATENT DOCUMENTS 3343233 6/1985 Germany ..... 439/369

*Primary Examiner*—Khiem Nguyen

[57] ABSTRACT

This electrical cord, plug and receptacle retainer is made from one piece that holds together plugs and receptacles by retaining their cords. Likewise, the line retainer, with the same end element as the cord retainer, can hold a boat fender to a desired position when line is secured in line retainer.

1 Claim, 2 Drawing Sheets

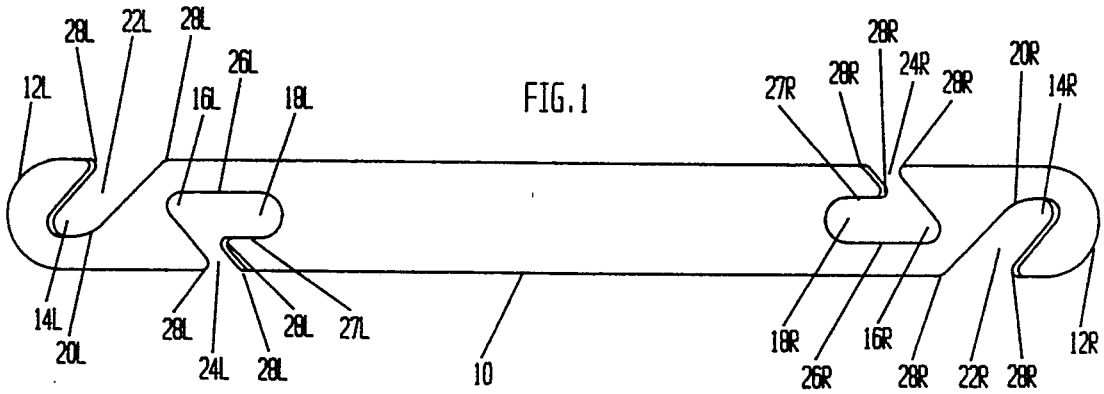
FIG.1
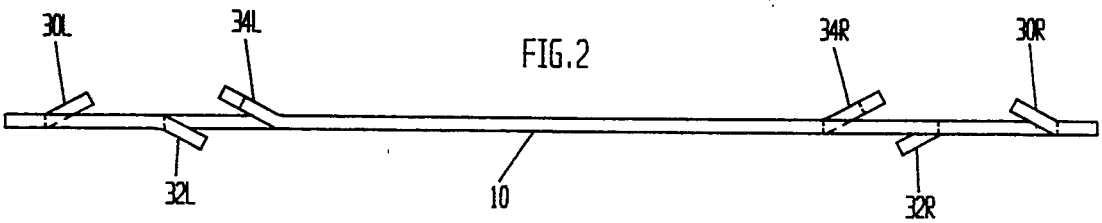
FIG.2
FIG.3
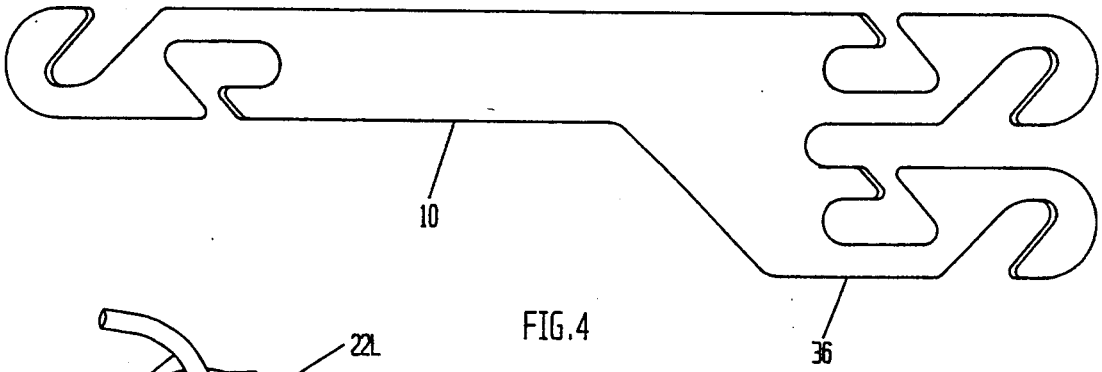
FIG.4
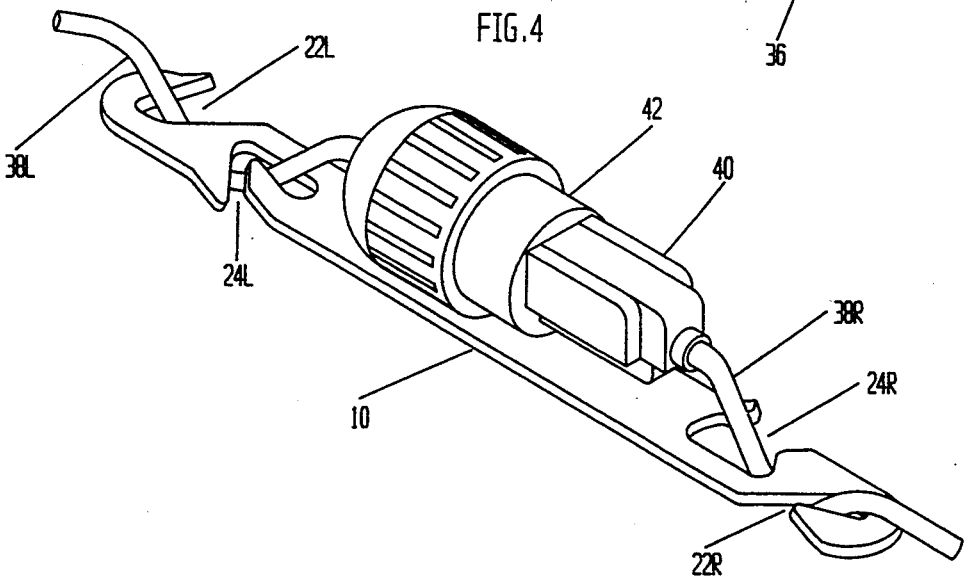

ELECTRICAL CORD, PLUG AND RECEPTACLE RETAINER AND LINE RETAINER

BACKGROUND OF THE INVENTION

1. Field of the Invention

This invention relates to holding and locking devices, particularly for electrical cord, plugs and receptacles and for securing braid or strand lines.

2. Description of Prior Art

The U.S. Pat. No. 5,133,671, shows two plastic saw-tooth strips for locking together an electrical plug and receptacle.

Another U.S. Pat. No. 5,044,976, shows electrical plugs secured to a wall receptacle using an elongated member attached to the wall receptacle along with a small clamp attached to the electrical cord and plug. The small clamp is affixed to the elongated member with the use of hook and loop fasteners glued on each part.

One of the few devices I have found on the market for holding plugs and receptacles is one by the trade mark of "Connect-A-Plug", manufactured by Doskocil Mfg. Co., Arlington, Tex. 76004-1246. This device holds the plug and receptacle by using an adjustable slide clamp which contains the plug and receptacle inside a plastic box.

All of the information I have found on devices for holding electrical plugs and receptacles have shown to be consisting of two or more parts, constructed with hook and loop fasteners or molded out of plastic. These multi-part devices are poorly designed and their composition makes them susceptible to premature wear and eventually, failure. Also, many of these devices are limited to holding only certain sizes of cords, plugs and receptacles. Most do not function well and can be very difficult to connect and disconnect.

SUMMARY OF THE INVENTION

The devices described above are made from multiple plastic parts that are difficult to use and can break easily. Another key point to recognize, these devices only hold together the plug and receptacle. The weakest part of a plug and receptacle is the cord casing and wires entering the plug and receptacle ends. These devices do nothing to prevent strain on the cord, cord casings, or the wires entering the plug and receptacle ends.

My invention will eliminate all of the above disadvantages. It consists of one solid piece which is designed to retain or hold together electrical cords, plugs and receptacles in a simplistic and efficient manner, as well as preventing damage incurred by pulling cord casings and wires from the plug and receptacle ends.

Having worked on construction sites and in shops, I have observed the many methods of tying electrical cords together. In most cases, these methods will eventually cause damage to the cord casings and wires in the plug and receptacle ends. My invention holds the strongest part of the cord gently and securely in what I call a "Double S" motion of the cords, without inflicting strain on the cords or wires in the plug and receptacle ends. This retainer is designed to accept all different types of electric cords and all shapes and sizes of plugs and receptacles on the cords. For example, electric cords vary from different diameters of round cords to different thickness and widths of flat cords, or any combination there of. In addition, electrical cords with multiple receptacle ends can be retained with two or more individual cord and plug ends. (see accompanying drawings)

With the many electric hand-held power tools manufactured today; saws, drills, hedge trimmers etc., the majority come with a very short electrical cord and plug. These instances will require the use of an extension cord for operation. This invention will retain the plug on the electrical device with the receptacle on the extension cord, enabling full use and mobility of the device without possible cord separation and without stress on the cord, plug or receptacle ends.

The other use of this invention, which utilizes the same retaining method as the electrical retainer, is the line retainer. This same method can be used to secure lines from boat fenders to a desired position.

Further features of the invention and description are shown in the accompanying drawings.

BRIEF DESCRIPTION OF THE DRAWINGS

This invention will be more fully understood by reference to the following detailed description when read in conjunction with the attached drawings and wherein:

FIG. 1 is a top view of developed blank of electrical cord, plug and receptacle retainer.

FIG. 2 is a side view of cord retainer after forming.

FIG. 3 is a top view of cord retainer with an added end for a second plug and cord.

FIG. 4 is a view of plug, receptacle and cords secured on cord retainer.

Figure 5:
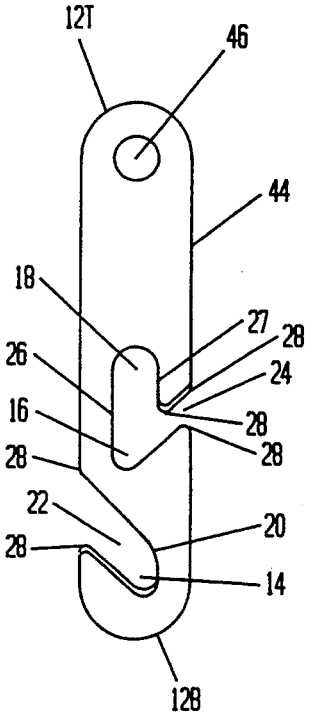
FIG. 5 is a top view of developed blank of line retainer.

Reference Numerals Used in the Drawings and Description

10—Electrical Cord, Plug and Receptacle Retainer.
12—end radius size
14—center point of a 3.17 mm radius in outer slot
16—center point of a 3.17 mm radius in inner slot
18—center point of a 5.21 mm radius
20—radius in outer slot
22—width of 45° angles in outer slot
24—width of 45° angles in inner slot
26—line that runs from inner 3.17 mm radius to 5.21 mm radius
27—line that runs from 5.21 mm radius to 3.17 mm inner slot
28—1.58 mm outside radius
30—angle of outside tabs
32—angle of center tabs
34—angle of inside tabs
36—added end of cord retainer
38—electrical cord
40—plug
42—receptacle
44—Line Retainer
46—through hole
48—line
50—boat rail or lifeline
52—end of boat fender

DETAILED DESCRIPTION OF THE RETAINERS

A combined electrical cord, plug and receptacle retainer and line retainer of this invention is composed of all working ends that are identical to each other.

FIG. 1 shows a developed blank of retainer 10 with a length of 26 cm, width of 25.4 mm and a thickness of 3.17 mm. Outside end radii 12L and 12R are 12.7 mm. A center point of a 3.17 mm radii 14L and 14R is 12.7 mm from end of 10 and offset 2.03 mm from latitudinal center line of 10. A center point of a 3.17 mm radii 16L and 16R is 41.14 mm from end of 10 and offset 2.03 mm from latitudinal center line of 10 in opposite direction of radii 14L and 14R. A center point of a 5.21 mm radii 18L and 18R is 60.2 mm from end of 10 on latitudinal center line of 10. Lines 26L and 26R are drawn between tangent points of radii 16L and 18L and 16R and 18R. A 45° angle slot 22L and 22R that is 10.4 mm wide, intersects a tangent point of radii 14L and 14R. To complete slot, a 10.3 mm radii 20L and 20R follows a 45° angle in slot 22L and 22R to a tangent point of radii 14L and 14R. A 45° angle slot 24L and 24R that is 3.17 mm wide, runs to a tangent point of radii 16L and 16R. Line 27L and 27R run from a tangent point of radii 18L and 18R to a 3.17 mm wide slot 24L and 24R. Outside radii 28L and 28R are 1.58 mm (shown in ten places).

FIG. 2 shows a side view of formed tabs on retainer 10. There are two outside tabs 30L and 30R formed up 28° from end of radii 14L and 14R. Two center tabs 32L and 32R are formed down 28° from end of radii 16L and 16R. Two inside tabs 34L and 34R are formed up 28° from end of radii 18L and 18R.

FIG. 3 is a top view of retainer 10 with an added end of cord retainer 36 which can accommodate an additional cord 38 and plug 40 for retaining a cord 38 with multiple receptacle ends 42.

FIG. 4 shows a retainer 10 with plug 40, receptacle 42 and cords 38L and 38R in place on retainer 10.

Use of Retainer in FIG. 4

This electrical cord, plug and receptacle retainer 10, provides a secure connection between plug 40 and receptacle 42 by holding cords 38L and 38R. Plug 40 and receptacle 42 are connected together and placed on top of retainer 10. Cords 38L and 38R are placed in slots 24L and 24R, which are then looped down to bottom side of retainer 10 and up through slots 22L and 22R. Connection is now complete. Disconnection of cords 38L and 38R can be achieved by reversing the above process.

Figure 6:
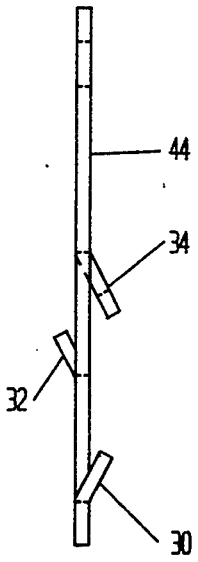
FIG. 6 is a side view of line retainer after forming.
Figure 7:
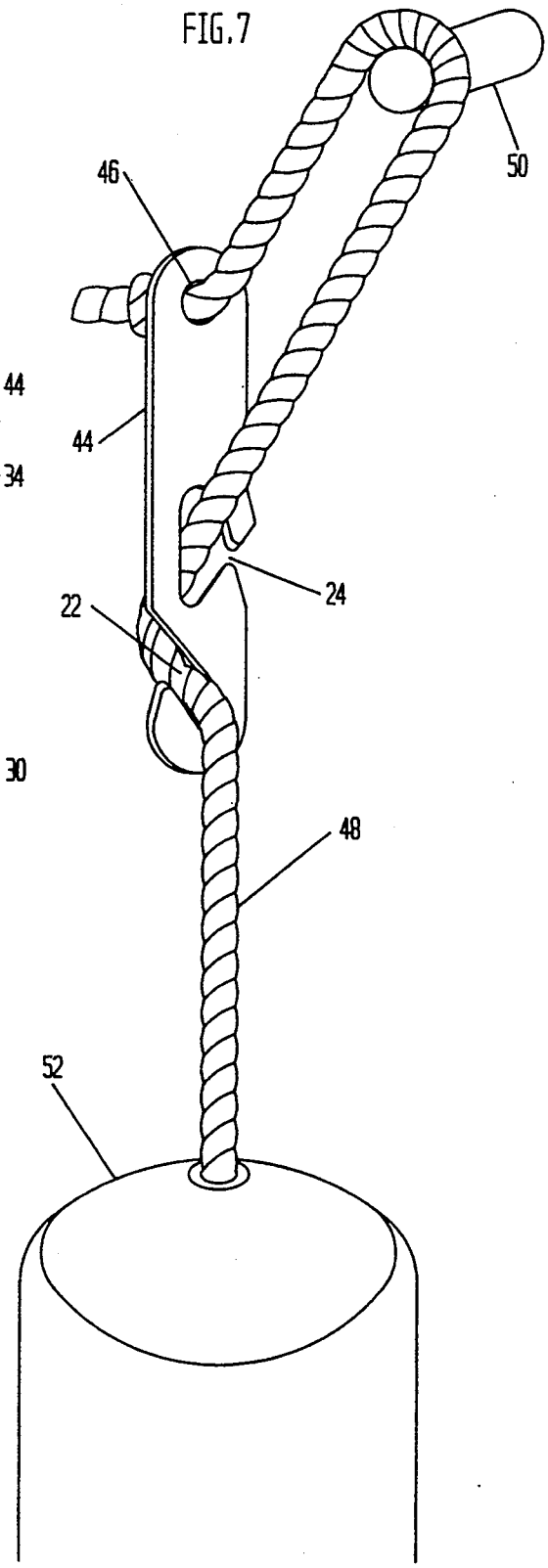
FIG. 7 is a view of line retainer holding boat fender and and line in place on a boat rail or lifeline.

FIGS. 5, 6 and 7—Line Retainer

FIG. 5 shows a developed blank of line retainer 44 with a same end element as retainer 10, with a length of 12.06 cm, width of 25.4 mm and a thickness of 3.17 mm. Outside end radii 12T and 12B are 12.7 mm. A center point of a 3.17 mm radius 14 is 12.7 mm from end of 44 and offset 2.03 mm from longitudinal center line of 44. A center point of a 3.17 mm radius 16 is 41.14 mm from end of 44 and offset 2.03 mm from longitudinal center line of 44 in opposite direction of radius 14. A center point of a 5.21 mm radius 18 is 60.2 mm from end of 44 on longitudinal center line of 44. Line 26 is drawn between tangent points of radii 16 and 18. A 45° angle slot 22 that is 10.4 mm wide, intersects tangent point of radius 14. To complete slot, a 10.3 mm radius 20 follows a 45° angle in slot 22 to tangent point of radius 14. A 45° angle slot that is 3.17 mm wide, runs to a tangent point of radius 16. Line 27 runs from tangent point of radius 18 to a 3.17 mm slot 24. Outside radii 28 are 1.58 mm (shown in five places). A center point of a 10.3 mm through hole 46 is on a longitudinal center line of 44 and is 12.7 mm from end of 12T.

FIG. 6 shows a side view of formed tabs on line retainer 44. Tab 30 is formed up 28° from end of radius 14. Center tab 32 is formed down 28° from end of radius 16. Tab 34 is formed up 28° from end of radius 18.

FIG. 7 shows end of boat fender 52 attached to line 48, which is wrapped around boat rail or lifeline 50, and ultimately secured in line retainer 44.

Use of Line Retainer in FIG. 7

Line 48 is attached to boat fender 52 and ran through hole 46 from top side of retainer 44. A knot is tied in line 48 on bottom side of retainer 44. Line 48 and retainer 44 are placed over and around boat rail or lifeline 50. When desired position of boat fender 52 is accomplished, line 48 is inserted into slot 24, looped down to bottom side of retainer 44, and up through slot 22. Boat fender is now held securely. Disconnection of line 48 is easily achieved by reversing the above process.

Manufacturing of the Retainers

The developed blank of the electrical cord, plug and receptacle retainer 10 (FIG. 1) can be manufactured from aluminum strip stock using a piercing and parting die. A form die can then be used to form tabs 30, 32 and 34 on retainer 10 (FIG. 2). This same procedure would apply to the line retainer 44 (FIGS. 5 and 6). After all sharp edges are removed, both retainers 10 and 44 would be coated with a thick plastic, acrylic or powder coating. Both retainers could also be manufactured from strong plastic or hard rubber using injection mold dies.

I claim:

1. A holding device for the purpose of preventing accidental disconnection between the electrical plug and receptacle ends by retaining their cords or for retaining a cord attached to a boat fender, comprising: a strip of rigid material with a non-conductive coating having a first end and a second end; said first end comprising of two unlike angular slots that intersect the longitudinal center line of said strip, first slot of predetermined angle, shape, and size commencing from one edge of said strip at a predetermined distance from end of said strip creating a single tab, said tab of a predetermined angle perpendicular to the longitudinal direction of said strip, second slot with a predetermined distance from said first slot having a predetermined angle, shape, and size commencing from the opposite edge of said strip creating two tabs, said two tabs of predetermined angles and in opposite directions perpendicular to the longitudinal direction of said strip, said second end of said strip comprising of two unlike angular slots and tabs identical to said first end of said strip, with said plug and said receptacle connected and placed on said strip, respective said cords are placed in opposite directions and inserted in corresponding said unlike angular slots.

* * * * *